US006978943B2

(12) United States Patent
Liu et al.

(10) Patent No.: US 6,978,943 B2
(45) Date of Patent: Dec. 27, 2005

(54) GOVERNOR PLATE APPARATUS

(75) Inventors: Zhengbai Liu, Lisle, IL (US); Xinqun Gui, Lisle, IL (US); Puning Wei, Lisle, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 541 days.

(21) Appl. No.: 10/060,597

(22) Filed: Jan. 30, 2002

(65) Prior Publication Data

US 2003/0141380 A1 Jul. 31, 2003

(51) Int. Cl.[7] ..... F02M 47/02; F02M 59/00; F02M 61/00; B05B 1/30

(52) U.S. Cl. ..... 239/88; 239/89; 239/90; 239/533.2; 239/533.12; 239/585.5

(58) Field of Search ..... 239/88, 89, 90, 239/91, 92, 93, 94, 95, 96, 533.2, 533.12, 239/585.5

(56) References Cited

U.S. PATENT DOCUMENTS

| | | | | |
|---|---|---|---|---|
| 5,720,318 | A * | 2/1998 | Nagarajan et al. | 137/625.64 |
| 5,826,562 | A | 10/1998 | Chen et al. | |
| 6,085,992 | A | 7/2000 | Chockley et al. | |
| 6,354,270 | B1 * | 3/2002 | Shafer | 123/446 |
| 6,364,282 | B1 * | 4/2002 | Ausman et al. | 251/129.16 |
| 6,412,705 | B1 * | 7/2002 | Desai et al. | 239/88 |
| 6,568,602 | B1 * | 5/2003 | Bram et al. | 239/5 |
| 6,715,694 | B2 * | 4/2004 | Gebhardt | 239/89 |
| 2003/0127539 | A1 * | 7/2003 | Braun et al. | 239/533.2 |

* cited by examiner

*Primary Examiner*—Davis Hwu
(74) *Attorney, Agent, or Firm*—Dennis Kelly Sullivan; Susan L. Lukasik; Jeffrey P. Calfa

(57) ABSTRACT

A flow controller assembly for use with a hydraulically-actuated, electrically-controlled fuel injector, includes a flow controller fluidly disposable intermediate an injector control valve assembly and an injector intensifier assembly for controlling flow of actuating fluid to and from the intensifier assembly to effect rate shaping of an injectable quantity of fuel and to effect a reduction of noise generated by the stopping of return motion of an intensifier piston. A fuel injector and a method of controlling an intensifier piston are also included.

72 Claims, 4 Drawing Sheets

GOVERNOR PLATE APPARATUS

TECHNICAL FIELD

The present invention relates to fuel injectors. More particularly, the present invention relates to hydraulically-actuated, electrically-controlled fuel injectors.

BACKGROUND OF THE INVENTION

Hydraulically-actuated, electrically-controlled fuel injectors are known. Such injectors are typically referred to as HEUI injectors. There is a need in the industry to better control the injection profile produced by a HEUI type injector. The injection profile of the injector may be enhanced through rate shaping. Further, there is a need to minimize the mechanical noise produced by the injector at the end of an injection event when actuating fluid is being vented from the injector.

SUMMARY OF THE INVENTION

The present invention substantially meets the aforementioned needs of the industry. A governor plate apparatus of the present invention is disposed between the control valve and the intensifier of a HEUI injector. After initiation of the pulse width command, during the filling process, the governor plate apparatus manipulates the rate shaping through the central check valve of the governor plate apparatus to optimize the injection profile of the injector. Further, during the drain or venting process, the governor plate apparatus controls the damping of the intensifier piston through a certain orifice(s) to reduce the mechanical noise of the injector as the intensifier piston comes to rest on a mechanical stop.

The present invention is a flow controller assembly for use with a hydraulically-actuated, electrically-controlled fuel injector, including a flow controller fluidly disposable intermediate an injector control valve assembly and an injector intensifier assembly for controlling flow of actuating fluid to and from the intensifier assembly to effect rate shaping of an injectable quantity of fuel and to effect a reduction of noise generated by an intensifier piston. The present invention is further a fuel injector and a method of controlling an intensifier piston.

DETAILED DESCRIPTION OF THE PREFERRED EMBODIMENT

Figure 1:
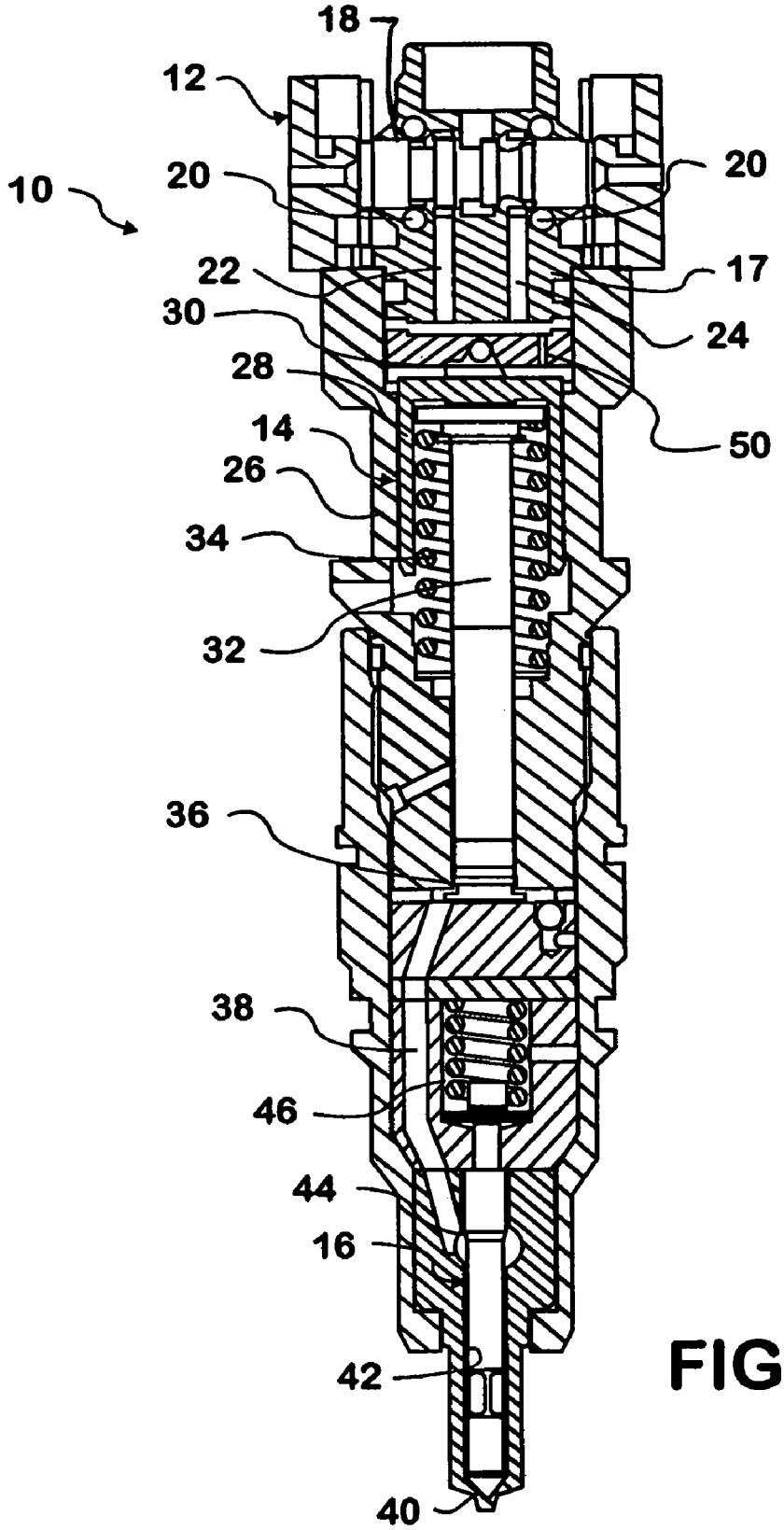
FIG. 1 is a sectional view of a fuel injector incorporating the governor plate apparatus of the present invention.

The injector of the present invention is shown generally at 10 in the figures. Injector 10 has three major components: control valve assembly 12, intensifier assembly 14, and needle valve assembly 16.

The first major component of the injector 10 is the control valve assembly 12. The control valve assembly 12 includes a control valve body 17. A spool valve 18 is translatably disposed within an aperture defined in the control valve body 17. A solenoid 20 is disposed at either end of the spool valve 18 for affecting shifting of the spool valve 18 between two opposed dispositions corresponding to an open disposition (actuating fluid being ported in) and a closed disposition (actuating fluid being vented).

The spool valve 18 is in fluid communication with an external source of actuating fluid under pressure. Additionally, the spool valve 18 is selectively in fluid communication with an actuating fluid reservoir at substantially ambient pressure of between 0 and 100 psi. An inlet passageway 22 is defined in the control valve body 17 and is in fluid communication with the spool valve 18. Additionally, a vent passageway 24 is defined in the control valve body 17 and is also in fluid communication with the spool valve 18. As will be seen, shifting of the spool valve 18 between the open and closed dispositions selectively communicates the external source of actuating fluid with the inlet passageway 22 and selectively communicates the external ambient reservoir with the vent passageway 24.

The second major component of the injector 10 is the intensifier assembly 14. The intensifier assembly 14 includes an intensifier body 26. An intensifier piston 28 is shiftably disposed in an aperture defined in the intensifier body 26. The upper margin of the intensifier piston 28 comprises an actuation surface 30. In prior art injectors, the actuation surface 30 is in direct and unrestricted fluid communication with both the inlet passageway 22 and the vent passageway 24. As will been seen below, such is not the case with the present invention.

The intensifier piston 28 is acted upon by a return spring 34. The bias of the return spring 34 acts in opposition to any fluid pressure acting on the actuation surface 30 and in fact generates fluid pressure during venting of actuation fluid. The intensifier piston 28 is operably coupled to a plunger 32. A variable volume pressure chamber 36 is defined proximate the lower margin of the plunger 32. The lower margin of the plunger 32 defines in part the pressure chamber 36. The pressure chamber 36 is selectively in communication with a source of fuel. A high-pressure fuel passage 38 is in fluid communication with the pressure chamber 36 and conveys high-pressure fuel from the pressure chamber 36 to the needle valve assembly 16.

The final major component of the injector 10 is the needle valve assembly 16. The needle valve assembly 16 includes an orifice or orifices 40 that are selectively in communication with a combustion chamber (not shown). The orifice 40 is opened and closed by a needle valve or check 42. The check 42 has a check surface 44. High-pressure fuel acting on the check surface 44 acts to shift the check 42 upward, opening the orifice 40. The upward shift of the check 42 acts in opposition to the bias exerted by the return spring 46. The absence of sufficient high-pressure acting on the check surface 44 causes the check 42 to be closed under the influence of the return spring 46.

The governor plate apparatus of the present invention is shown generally at 50 in the figures. The governor plate apparatus 50 is disposed intermediate the respective inlet passageway 22 and vent passageway 24 of the control valve assembly 12 and the actuation surface 30 of the intensifier piston 28 of the intensifier assembly 14. Accordingly, the governor plate apparatus 50 is fluidly disposed between the control valve assembly 12 and the intensifier assembly 14. The governor plate apparatus 50 may include a top plate 52 and a bottom plate 54 that are mated together to substantially define the governor plate apparatus 50.

Figure 2:
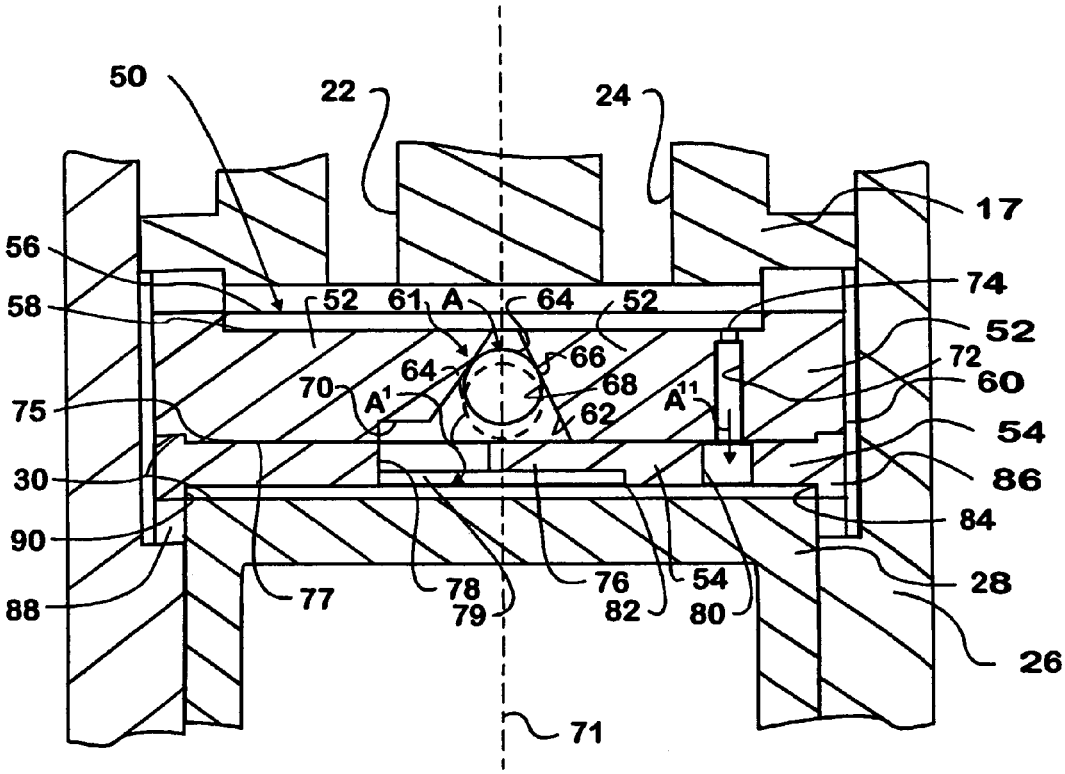
FIG. 2 is an enlarged sectional view of the governor plate apparatus of the present invention with the intensifier piston in the full up retracted seated disposition.

With reference to FIG. 2, the governor plate apparatus 50 is depicted as having two major components: top plate 52 and bottom plate 54. The governor plate apparatus 50 is depicted as having two components for ease of manufacturing, but could as well be formed as an integral unit.

The first component of the governor plate apparatus 50 is the top plate 52. The top plate 52 is spaced apart from the control valve body 17 to define a flow chamber 56. The flow chamber 56 is defined in part by the upper margin 58 of the top plate 52. The top plate 52 (and the bottom plate 54) are spaced apart from the intensifier body 26 to define an annular passage 60 around the governor plate apparatus 50. The annular passage 60 is in fluid communication with the flow chamber 56.

A check valve 61 includes a conical bore 62 is defined through the top plate 52. At a first end, the conical bore 62 is fluid communication with the flow chamber 56. The check valve 61 further includes a shiftable ball valve 64 is disposed within the conical bore 62. As depicted in FIG. 2, at the upper limit of the travel of the ball valve 64, the ball valve 64 defines a substantially fluid tight seal with the seat 66. The seat 66 is in fact a portion of the conical bore 62. At the lower limit of the travel of the ball valve 64, depicted in phantom in FIG. 2, a flow aperture 68 is defined around the ball valve 64 between the exterior margin of the ball valve 64 and the conical bore 62. The ball valve 64 in cooperation with the conical bore 62 are the primary components of the check valve 61.

A horizontal cut 70 intersects the conical bore 62 proximate the lower margin of the conical bore 62. The horizontal cut 70 is offset from the center axis 71 of the governor plate apparatus 50. The horizontal cut 70 intersects and is open at the lower margin 75 of the top plate 52.

At least one additional flow passageway is defined through the top plate 52. Passageway 72 is a relatively small bore that is in fluid communication with the flow chamber 56 and is open at the lower margin 75. Passageway 72 includes a restriction defining a damping or throttling orifice 74. The flow area of the damping orifice 74 is substantially reduced with respect to the flow area of the passageway 72 and has a selected area to effect dampening of the return motion of the intensifier piston 28 as is described in greater detail below.

The second component of the governor plate apparatus 50 is the bottom plate 54, The bottom plate 54 includes a floor 76 that comprises in part the upper margin 77 of the bottom plate 54. When the bottom plate 54 is mated to the top plated 52, the floor 76 substantially underlies the conical bore 62 and acts to retain the ball valve 64 within the conical bore 62. A relatively large bore 78 is defined adjacent to the floor 76. When the bottom plate 54 and top plate 52 are mated, the bore 78 is at least partially in registry with the horizontal cut 70 and thereby comprises an extension of the flow passageway defined by the conical bore 62. The bore 78 opens into an even larger flow area 79 defined in the bottom plate 54. The flow area 79 is preferably circular in shape and concentric with the axis 71. Further, the aperture 80 is in registry with the passageway 72 and comprises an extension of the flow passageway 72 to actuation surface 30 of intensifier piston 28.

When the bottom plate 54 is mated with the top plate 52, the upper margin 77 of the bottom plate 54 is abutted to the lower margin 75 of the top plate 52. The bottom plate 54 and the top plate 52 may be fixably joined in the mated disposition.

Figure 4:
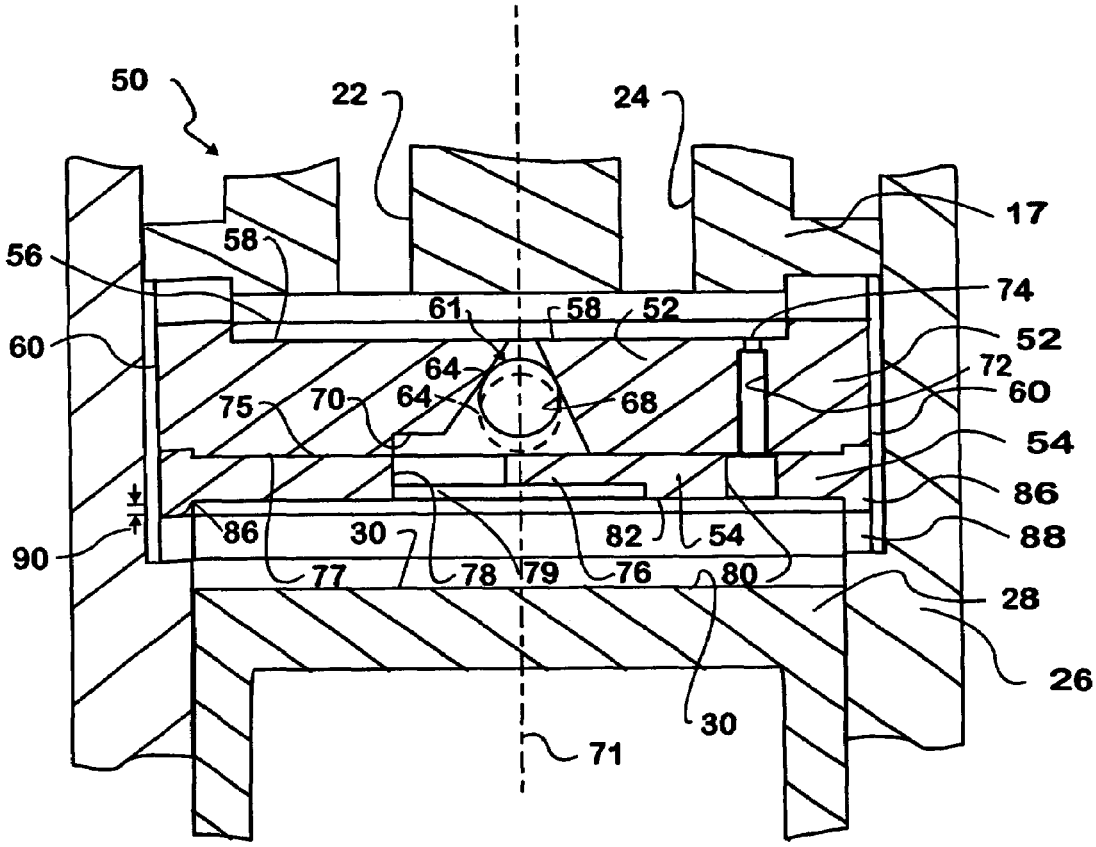
FIG. 4 is the governor plate apparatus of FIG. 2 with the intensifier piston in the down extended disposition.

The lower margin 82 of the bottom plate 54 includes a relatively large circular recess 84. The area of the recess 84 is significantly greater than the area of the flow area 79. The flow area 79 is in fluid communication with the recess 84. The recess 84 is defined by an annular lip 86. The annular lip 86 has a lip height 90, as depicted in FIG. 4. The recess 84 has a circumference that is slightly greater than the circumference of the intensifier piston 28 such that the intensifier piston 28 may translate into and out of the recess 84. Radialslots 88 are defined in the lower portion of the annular lip 86. The radial slots 88 establish fluid communication between the annular passage 60 and the actuation surface 30.

The governor plate apparatus 50 of the present invention is designed primarily for use with and being an integral component of a hydraulically-actuated fuel injector 10, as noted in FIG. 1. The fuel injector 10 has an electric controller for controlling the flow of a high pressure actuating fluid responsive to initiation and sensation of a pulse width command. The pulse width command defines the duration of an injection event. The fuel injector 10 includes an intensifier assembly 14, as described above, that is in fluid communication with the control valve assembly 12, the intensifier assembly 14 being translatable to increase the pressure of a volume of fuel for injection into a combustion chamber of a diesel engine.

In operation, after initiation of the pulse width command and during the filling process when the high pressure actuating fluid is being ported through the inlet passageway 22 to the flow chamber 56, the governor plate apparatus 50 manipulates the rate shaping of the fuel injection pulse by means of the central check valve 61, primarily comprising the ball valve 64 disposed in the conical bore 62, to optimize the injection profile of the fuel injector 10. During the drain process when the vent passageway 24 is open to a low pressure reservoir, the governor plate apparatus 50 controls the damping of the intensifier piston 28 by means of controlling the flow of the venting actuating fluid through the damping orifice(s) 74 in order to reduce the mechanical noise generated by the fuel injector 10 as the intensifier piston 28 seats against the lower margin 82 of the governor plate apparatus 50, comprising the return stop of the intensifier piston 28.

Referring to FIG. 2, the initial position prior to initiation of the pulse width command is depicted. The top margin (actuation surface 30) of the intensifier piston 28 is in contact with (seated on) the lower margin 82 of the bottom plate 54. The upper portion of the piston 28 resides within the recess 84 against the lower margin 82. The slots 88 are substantially sealed off by the piston 28.

When injection begins through opening (leftward shifting) of the spool valve 18, a relatively restricted flow of actuating fluid flows into the conical bore 62 forcing the ball valve 64 to its lowest disposition. The actuating fluid flows past the flow aperture 68 to bear on a relatively small portion of the actuation surface 30 of the intensifier piston 28, as indicated by arrows A, A1. The very small incidental quantity of actuation fluid flows through the passageway 72 as indicated by the arrow A11. No actuation fluid flows through the annular passages 60 since the slots 88 are effectively sealed off by the piston 28 residing in the recess 84.

As compared to HEUI fuel injector 10 without the governor plate apparatus 50, the initial injection pressure of the fuel being acted upon by the intensifier piston is relatively low due to the relatively small fluid pressure area on the intensifier piston 28 underlying flow area 79 that is initially exposed to actuating fluid. This limited pressure area is exposed to actuating fluid pressure when the actuation surface 30 of the intensifier piston 28 is in contact with the lower margin 82 of the bottom plate 54. Initial motion of the intensifier piston 28 is retarded due to the relatively low force generated of the actuation surface 30 by the actuating fluid.

After the intensifier piston 28 moves downward slightly, the actuation fluid flows outward in the recess 84 exposing a much greater area of the actuation surface 30 to actuation fluid pressure. Nonetheless, the motion of the intensifier piston 28 is still retarded due to the fact that the flow rate through the flow aperture 68 around the ball valve 64 is relatively small. During this phase of the injection invent, rate shaping occurs due to the restraining effects of the check valve 61 of the governor plate apparatus 50 in porting high pressure actuating fluid to the intensifier piston 28. The check 42 opens slightly during this phase of the injection event and injection through the orifice 40 gradually rises in accordance with the rate shaping feature of the present invention.

Figure 3:
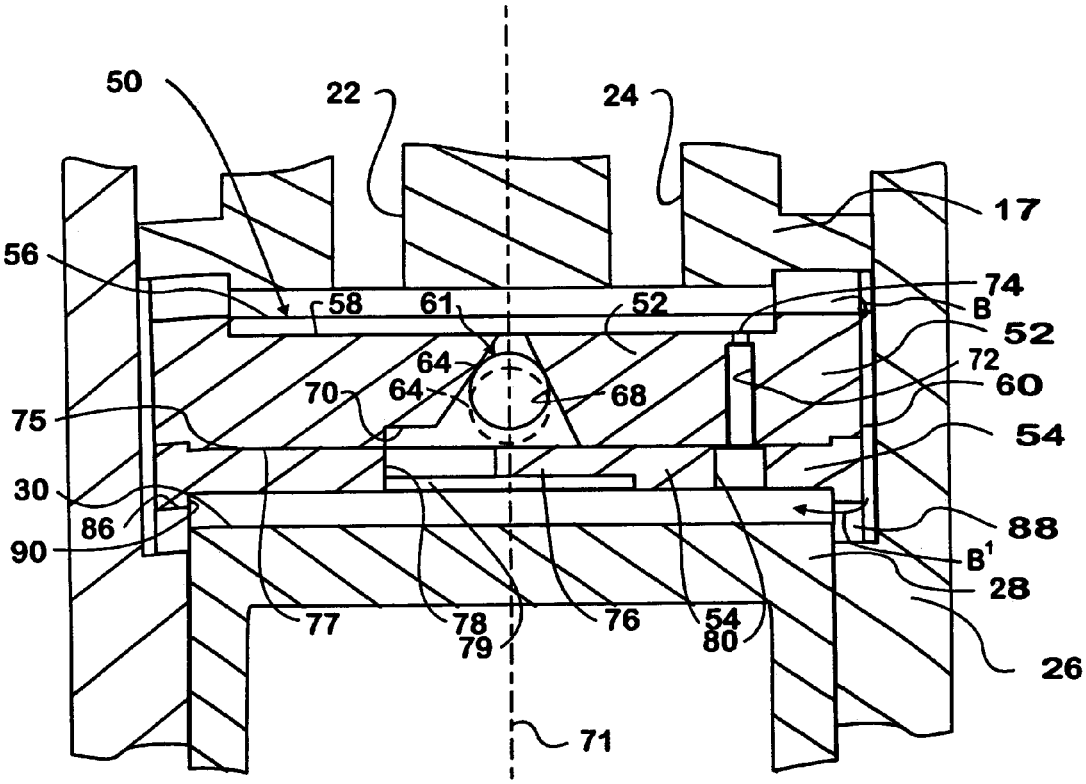
FIG. 3 is the governor plate apparatus of FIG. 2 with the intensifier piston in translation between the full up and full down disposition.

Referring to FIG. 3, the intensifier piston 28 has continued to descend, clearing the annular lip 86 of the recess 84. This motion of the intensifier piston 28 terminates the rate shaping stage of the injection event and commences the main injection stage. At this point, the motion of the intensifier piston 28 unseals the slots 88 and the full volume actuating fluid flows through the annular passage 60 and the slots 88 to bear on the actuation surface 30 of the intensifier piston 28 as indicated by arrows B, B1. The downward motion of the intensifier piston 28 accelerates under the influence of a substantially greater volume of high-pressure actuating fluid bearing on the actuation surface 30 to generate a substantial force on the actuation surface 30. Fuel injection through the orifices 40 ramps up very rapidly to the maximum rate of injection into the combustion chamber. It should be noted that during the main injection stage of the injection event, actuating fluid continues to flow as indicated by arrows A, A1, and A11, but the greatest portion of actuation fluid being ported to the intensifier piston 28 is via the annular passage 60.

The intensifier piston 28 continues downward to its fully extended disposition as depicted in FIG. 4. At this point, the injection event is terminated by shifting the spool valve 18 rightward, thereby closing the inlet passage 22 and opening the vent passageway 24. With the venting of the actuation fluid, pressure on the actuation surface 30 of the intensifier piston 28 decays to near zero. At this point, the return spring 34 acts upward on the intensifier piston 28 to return the intensifier piston 28 to the initial disposition against the lower margin 82 stop, as depicted in FIG. 2. The upward motion of the intensifier piston 28 is restrained by the residual actuating fluid that must be vented out the vent passageway 24. The bias exerted by the return spring 34 acts to pressurize the residual actuating fluid, shifting the ball valve 64 from its lower, open disposition to its upper, sealed disposition in contact with the seat 66 thereby closing the check valve 61. The actuation fluid flows outward opposite to the direction of flow indicated by arrows A11, B, and B1. The greatest majority of the venting actuation fluid flows initially through the slots 88 and the annular passage 60 to the vent passageway 24. As the intensifier piston 28 translates upward from the position depicted in FIG. 4 to the position depicted in FIG. 3 and thence to the position depicted in FIG. 2, the slots 88 are sealed off as the intensifier piston 28 re-enters the recess 84. As is appreciated the lip height 90 of the annulus lip 86 is selected to effect a desired amount of dampening of the intensifier piston 28 return motion, for dampening commences once the lip 86 is passed by the intensifier piston 28 and continues until the intensifier piston 28 is seated (stopped) on margin 82.

As noted above, once the slots 88 are sealed off during the upward translation of the intensifier piston 28, the damping stage begins. Since the slots 88 are sealed off and the ball valve 64 is seated against the seat 66, the only path for the venting actuation fluid is through passageway 72 opposite to the direction of flow indicated by the arrow A11 and through the damping orifice 74. The rate of upward translation of the intensifier piston 28 is greatly reduced by the throttling effect of the damping orifice 74. The result is that the actuation surface 30 of the intensifier piston 28 comes gently to rest in contact with the lower margin 82 of the bottom plate 54. This gentle, dampened stopping of the upward translation of the intensifier piston 28 greatly reduces the volume and intensity of noise generated by the stopping of the intensifier piston 28.

The governor plate apparatus 50 of the present invention includes the following as some of its unique features as compared to existing fuel injectors not incorporating the governor plate apparatus 50:

(a) The size of the check valve 61 comprising in part the conical bore 62 and the ball valve 64, influences the rate shaping.

(b) The clearance between the intensifier body 26 and the governor plate apparatus 50 comprising the annular passage 60 forms the drain passage.

(c) The distance from the slots 88 to the lower margin 82 of the bottom plate 54 comprising lip height 90 influences the damping of the return motion of the intensifier piston 28.

(d) At least one dampening orifice 74 may be included but more dampening orifices 74 may be included as needed.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A flow controller assembly for use with a hydraulically-actuated, electrically-controlled fuel injector, comprising:

a flow controller fluidly disposable intermediate an injector control valve assembly and an injector intensifier assembly for controlling flow of actuating fluid to and from the intensifier assembly to affect liftoff of an intensifier for effecting rate shaping of an injectable quantity of fuel and to affect landing of an intensifier for effecting a reduction of noise generated by stopping of an intensifier piston.

2. The flow controller assembly of claim 1 having a check valve, the check valve effecting throttling the flow of actuating fluid from the injector control valve assembly to the injector intensifier assembly to effect rate shaping during an initial portion of an injection event.

3. The flow controller assembly of claim 1 having a check valve, the check valve acting to limit initial stroke motion of the intensifier piston from a return disposition to an extended disposition.

4. The flow controller assembly of claim 1 having an annular flow passage being selectively openable to effect a relatively high volume fluid communication between the injector control valve assembly and the injector intensifier assembly.

5. The flow controller assembly of claim 4, the flow controller acting in cooperation with the intensifier piston to selectively open and close the annular flow passage.

6. The flow controller assembly of claim 5, the intensifier piston acting to close the annular flow passage when the intensifier piston is disposed proximate the flow controller.

7. The flow controller assembly of claim 4, the intensifier piston having a intensifying stroke and an opposed return stroke, the annular flow passage being a flow conduit for porting actuating fluid to the intensifier piston for at least a portion of the intensifier piston intensifying stroke and for venting actuating fluid from the intensifier piston for at least a portion of the intensifier piston return stroke.

8. The flow controller assembly of claim 1, the intensifier piston having a intensifying stroke and an opposed return stroke, a dampening orifice being defined in the flow controller, the dampening orifice throttling a venting of actuating fluid from the intensifier piston for a portion of the return stroke of the intensifier piston.

9. The flow controller assembly of claim 8, the dampening orifice effecting a reduction in the rate of intensifier return stroke motion proximate the flow controller.

10. The flow controller assembly of claim 8, the dampening orifice effecting a substantially noise free seating of the intensifier piston at the termination of intensifier return stroke motion.

11. The flow controller assembly of claim 1, the intensifier piston having an actuation surface the flow controller exposing a nominal portion of the actuating surface to actuating fluid during an initial stage of an injection event.

12. The flow controller assembly of claim 11, exposing a nominal portion of the actuating surface to actuating fluid during the initial stage of an injection event acting to minimize a force generated on the actuating surface for effecting a reduction of the initial rate of motion of the intensifier piston in an intensifying stroke.

13. The flow controller assembly of claim 11, the flow controller effecting rate shaping by exposing a nominal portion of the actuating surface to actuating fluid during the initial stage of an injection event to effect a reduction of the initial rate of motion of the intensifier piston in an intensifying stroke.

14. The flow controller assembly of claim 11, the flow controller gradually exposing a greater portion of the actuating surface to actuating fluid with the passage of time subsequent to initiation of the injection event.

15. A governor plate apparatus for use with a hydraulically-actuated, electrically-controlled fuel injector, comprising:

a flow controller fluidly disposable intermediate an injector control valve assembly and an injector intensifier assembly for controlling flow of actuating fluid to and from the intensifier assembly to affect liftoff of an intensifier for effecting rate shaping of an injectable quantity of fuel and to affect landing of the intensifier for effecting a reduction of noise generated by stopping of an intensifier piston.

16. The governor plate apparatus of claim 15, the flow controller having an upper margin, the upper margin defining in part an actuating fluid flow chamber.

17. The governor plate apparatus of claim 15, the flow controller being disposable in an aperture defined in a body, the flow controller being spaced apart from the aperture to define an annular passage.

18. The governor plate apparatus of claim 15, the flow controller defining at least three actuating fluid flow passages between the injector control valve assembly and the injector intensifier assembly, the at least three flow passages being an annular passage, a checked passage, and a throttled orifice.

19. The governor plate apparatus of claim 18, the flow controller being a return seat for the intensifier piston.

20. The governor plate apparatus of claim 19, the return seat being a recess defined within an annular lip.

21. The governor plate apparatus of claim 20, the intensifier piston substantially sealing the annular passage when a portion of the intensifier piston is disposed within the annular lip.

22. The governor plate apparatus of claim 20, the annular lip having a slot of a selected height dimension spaced from a lower margin of the governor plate, the height dimension affecting the dampening of a return motion of an intensifier piston when a portion of the intensifier piston is disposed within the annular lip.

23. The governor plate apparatus of claim 22, the return motion of the intensifier piston being dampened when any portion of the intensifier piston is disposed to cover the slot within the annular lip.

24. The governor plate apparatus of claim 22, the return motion of the intensifier piston being dampened for substantially the full extent of travel of the height dimension of the annular lip above the slot.

25. The governor plate apparatus of claim 18, the checked passage being a flow passage defining a seat, a ball valve being translatably disposed in the flow passage and being shiftable between a closed disposition seated on the seat and an open disposition, a selected flow area being defined between the flow passage and the ball valve when the ball valve is in the open disposition.

26. The governor plate apparatus of claim 25, the checked passage being in flow communication with an actuation surface of the intensifier piston, the checked passage exposing a nominal portion of the actuating surface to actuating fluid when the intensifier piston is seated against a flow controller return seat.

27. The governor plate apparatus of claim 26, the checked passage being in flow communication with a flow area defined in the lower margin of the flow controller, the flow area being in fluid communication with the actuation surface and exposing the nominal portion of the actuating surface to actuating fluid when the intensifier piston is seated against the flow controller return seat.

28. The governor plate apparatus of claim 25, the ball valve being seatable on the seat by fluid pressure generated by a return motion of the intensifier piston.

29. The governor plate apparatus of claim 18, at least a portion of the actuation fluid that is being vented by a return motion of the intensifier piston being throttled by the throttling orifice.

30. The governor plate apparatus of claim 29, actuation fluid throttled by the throttling orifice acting to retard the rate of return motion of the intensifier piston.

31. A hydraulically-actuated, electrically-controlled fuel injector, comprising:

an injector control valve assembly;

an injector intensifier assembly being selectively in fluid communication with the injector control valve assembly; and a flow controller fluidly disposed intermediate the injector control valve assembly and the intensifier assembly for controlling flow of actuating fluid to and from the intensifier assembly to affect liftoff of an intensifier for effecting rate shaping of an injectable quantity of fuel and to affect landing of the intensifier for effecting a reduction of noise generated by stopping of an intensifier piston.

32. The fuel injector of claim 31 having a check valve, the check valve effecting throttling the flow of actuating fluid from the injector control valve assembly to the injector intensifier assembly to effect rate shaping during an initial portion of an injection event.

33. The fuel injector of claim 31 having a check valve, the check valve acting to limit initial stroke motion of the intensifier piston from a return disposition to an extended disposition.

34. The fuel injector of claim 31 having an annular flow passage being selectively openable to effect a relatively high volume fluid communication between the injector control valve assembly and the injector intensifier assembly.

35. The fuel injector of claim 34, the flow controller acting in cooperation with the intensifier piston to selectively open and close the annular flow passage.

36. The fuel injector of claim 35, the intensifier piston acting to close the annular flow passage when the intensifier piston is disposed proximate the flow controller.

37. The fuel injector of claim 34, the intensifier piston having an intensifying stroke and an opposed return stroke, the annular flow passage being a flow conduit for porting actuating fluid to the intensifier piston at least for a portion of the intensifier piston intensifying stroke and for venting actuating fluid from the intensifier piston at least for a portion of the intensifier piston return stroke.

38. The fuel injector of claim 31, the intensifier piston having an intensifying stroke and an opposed return stroke, a dampening orifice being defined in the flow controller, the dampening orifice throttling a venting of actuating fluid from the intensifier piston for a portion of the return stroke of the intensifier piston.

39. The fuel injector of claim 38, the dampening orifice effecting a reduction in the rate of the intensifier return stroke motion proximate the flow controller.

40. The fuel injector of claim 38, the dampening orifice effecting a substantially noise free seating of the intensifier piston at the termination of intensifier return stroke motion.

41. The fuel injector of claim 31, the intensifier piston having an actuation surface, the flow controller exposing a nominal portion of the actuating surface to actuating fluid during an initial stage of an injection event.

42. The fuel injector of claim 41, exposing a nominal portion of the actuating surface to actuating fluid during the initial stage of an injection event acting to minimize a force generated on the actuating surface for effecting a reduction of the initial rate of motion of the intensifier piston in an intensifying stroke.

43. The fuel injector of claim 41, the flow controller effecting rate shaping by exposing a nominal portion of the actuating surface to actuating fluid during the initial stage of an injection event to effect a reduction of the initial rate of motion of the intensifier piston in an intensifying stroke.

44. The fuel injector of claim 41, the flow controller gradually exposing a greater portion of the actuating surface to actuating fluid with the passage of time subsequent to initiation of the injection event.

45. The fuel injector of claim 31, the flow controller having an upper margin, the upper margin defining in part an actuating fluid flow chamber.

46. The fuel injector of claim 31, the flow controller being disposable in an aperture defined in a body, the flow controller being spaced apart from the aperture to define an annular passage.

47. The fuel injector of claim 31, the flow controller defining at least three flow passages between the injector control valve assembly and the injector intensifier assembly, the at least three actuating fluid flow passages being an annular passage, a checked passage, and a throttled orifice.

48. The fuel injector of claim 47, the flow controller being a return seat for the intensifier piston.

49. The fuel injector of claim 48, the return seat being a recess defined within an annular lip.

50. The fuel injector of claim 49 wherein a distal portion of the annular lip has a radial slot, the intensifier piston substantially sealing the annular passage when a portion of the intensifier piston is disposed within the annular lip inwardly of the slot.

51. The fuel injector of claim 49, the annular lip having a selected height dimension, the height dimension affecting the dampening of a return motion of an intensifier piston when a portion of the intensifier piston is disposed within the annular lip.

52. The fuel injector of claim 51 wherein the annular lip has a radial slot, the return motion of the intensifier piston being dampened when any portion of the intensifier piston is disposed within the annular lip above the slot.

53. The fuel injector of claim 47, the checked passage being a flow passage defining a seat, a ball valve being translatably disposed in the flow passage and being shiftable between a closed disposition seated on the seat and an open disposition, a selected flow area being defined between the flow passage and the ball valve when the ball valve is in the open disposition.

54. The fuel injector of claim 53, the checked passage being in fluid communication with an actuation surface of the intensifier piston, the checked passage exposing a nominal portion of the actuating surface to actuating fluid when the intensifier piston is seated against a flow controller return seat.

55. The fuel injector of claim 53, the ball valve being seatable on the seat by fluid pressure generated by a return motion of the intensifier piston.

56. The fuel injector of claim 55, the checked passage being in fluid communication with a flow area defined in the lower margin of the flow controller, the flow area being in fluid communication with the actuation surface and exposing the nominal portion of the actuating surface to actuating fluid when the intensifier piston is seated against the flow controller return seat.

57. The fuel injector of claim 47, at least a portion of the actuation fluid that is being vented by a return motion of the intensifier piston being throttled by the throttling orifice.

58. The fuel injector of claim 57, actuation fluid throttled by the throttling orifice acting to retard the rate of return motion of the intensifier piston.

59. In a hydraulically-actuated, electrically-controlled fuel injector, a method of controlling an intensifier piston, comprising:

controlling flow of actuating fluid to the intensifier piston to effect rate shaping of an injectable quantity of fuel by means of a flow controller; and controlling flow of actuating fluid from the intensifier piston by means of the flow controller to effect a reduction of noise generated by an intensifier piston as the intensifier piston seats on a return seat.

60. The method of claim 59 including throttling the flow of actuating fluid from an injector control valve assembly to the injector intensifier piston for an initial portion of an injection event.

61. The method of claim 59 including limiting initial stroke rate of motion of the intensifier piston, the intensifier motion being shifting from a return disposition to an extended disposition.

62. The method of claim 59 including selectively opening an annular passage to effect a relatively high volume fluid communication between the injector control valve assembly and the injector intensifier assembly.

63. The method of claim 62, including actuating the intensifier piston in cooperation with the flow controller to selectively open and close the annular flow passage.

64. The method of claim 63, including closing the annular flow passage when the intensifier piston is disposed proximate the flow controller.

65. The method of claim 62, porting actuating fluid to the intensifier piston through the annular flow passage for a portion of an intensifier piston intensifying stroke and venting actuating fluid from the intensifier piston through the annular flow passage for a portion of the intensifier piston return stroke.

66. The method of claim 59, including throttling a venting flow of actuating fluid from the intensifier piston for a final portion of the return stroke of the intensifier piston.

67. The method of claim 66, including reducing the rate of intensifier return stroke motion proximate the flow controller by means of a throttled flow of venting actuating fluid.

68. The method of claim 66, including effecting a substantially noise free seating of the intensifier piston at the termination of intensifier return stroke motion by means of a throttled flow of venting actuating fluid.

69. The method of claim 59, including exposing a nominal portion of an intensifier piston actuating surface to actuating fluid during an initial stage of an injection event.

70. The method of claim 69, including minimizing a force generated on the actuating surface for effecting a reduction of the initial rate of motion of the intensifier piston in an intensifying stroke by exposing a nominal portion of the actuating surface to actuating fluid during the initial stage of an injection event.

71. The method of claim 69, including effecting rate shaping by exposing a nominal portion of the actuating surface to actuating fluid during the initial stage of an injection event.

72. The method of claim 69, including gradually exposing a greater portion of the actuating surface to actuating fluid with the passage of time subsequent to initiation of the injection event.

* * * * *